US009321158B2

(12) United States Patent
Calvert

(10) Patent No.: US 9,321,158 B2
(45) Date of Patent: Apr. 26, 2016

(54) POLE ASSEMBLY

(71) Applicant: Chris Calvert, Gilbert, AZ (US)

(72) Inventor: Chris Calvert, Gilbert, AZ (US)

( * ) Notice: Subject to any disclaimer, the term of this patent is extended or adjusted under 35 U.S.C. 154(b) by 318 days.

(21) Appl. No.: 13/670,437

(22) Filed: Nov. 6, 2012

(65) Prior Publication Data

US 2013/0145905 A1 Jun. 13, 2013

Related U.S. Application Data

(60) Provisional application No. 61/568,585, filed on Dec. 8, 2011.

(51) Int. Cl.

| | |
|---|---|
| ***B25B 23/16*** | (2006.01) |
| ***B25B 23/00*** | (2006.01) |
| ***B25B 9/00*** | (2006.01) |
| *H01K 3/32* | (2006.01) |

(52) U.S. Cl.

CPC ..... *B25B 23/0035* (2013.01); *B25B 9/00* (2013.01); *B25B 23/16* (2013.01); *H01K 3/32* (2013.01)

(58) Field of Classification Search

CPC ..... B25B 23/16; B25B 9/00; H01K 3/32

USPC ..... 81/53.1, 53.11, 177.2, 121.1

See application file for complete search history.

(56) References Cited

U.S. PATENT DOCUMENTS

| | | | | | |
|---|---|---|---|---|---|
| 1,723,216 | A * | 8/1929 | Stam | 52/223.5 |
| 4,689,881 | A * | 9/1987 | Fall | 29/813 |
| 5,154,104 | A * | 10/1992 | O | 81/177.2 |
| 5,809,851 | A * | 9/1998 | Thompson | 81/124.2 |
| 6,453,777 | B1 * | 9/2002 | Newman et al. | 81/53.11 |
| 6,786,116 | B2 * | 9/2004 | Dockery | 81/177.1 |
| 7,127,972 | B2 * | 10/2006 | Klein et al. | 81/177.2 |
| 7,231,852 | B1 * | 6/2007 | Henin et al. | 81/124.2 |
| 8,671,805 | B2 * | 3/2014 | Henderson et al. | 81/124.2 |
| 2002/0088313 | A1 * | 7/2002 | Dockery | 81/121.1 |

* cited by examiner

*Primary Examiner* — Hadi Shakeri
*Assistant Examiner* — Danny Hong
(74) *Attorney, Agent, or Firm* — Greg L. Martinez

(57) ABSTRACT

A pole assembly includes a chuck, and the chuck includes a chuck body with opposed fastener openings extending therethrough, and a shank. The pole assembly includes a socket piece, and the socket piece includes a conduit fitting body and a socket piece body, and opposed fastener openings extending through the conduit fitting body, and a socketed body opening extending through the socket fitting body. The pole assembly includes a conduit which extends through a distal chuck body opening of the chuck and an unsocketed body opening of the conduit fitting body.

10 Claims, 22 Drawing Sheets

POLE ASSEMBLY

CROSS-REFERENCE TO RELATED APPLICATIONS

This application claims the benefit of U.S. Provisional Application No. 61/568,585, entitled "A CUSTOMIZABLE EXTENSION SOCKET INSTALLATION TOOL FOR VERTICAL MOUNT WOOD AND STEEL FASTENERS SUCH AS SAMMY'S", which was filed on Dec. 8, 2011, the contents of which are incorporated by reference as though fully set forth herein.

BACKGROUND OF THE INVENTION

1. Field of the Invention

This invention relates generally to hand and hoist-line implements.

2. Description of the Related Art

It is often necessary for a person, such as an electrician, to hoist an object to a height that the electrician cannot reach. For example, an electrician's pole can be used to hoist a screw to a ceiling, wherein the screw is threaded into the ceiling using the pole. One type of electrician's pole is often referred to as a Lagmaster Pole, and it can be used to hoist many different types of objects, such as a wire, threaded and smooth rods, a jack chain and a J-hook. One problem with the available electrician's poles is that they are expensive and limited in size and strength.

BRIEF SUMMARY OF THE INVENTION

The present invention is directed to a pole assembly for hoisting an object. The novel features of the invention are set forth with particularity in the appended claims. The invention will be best understood from the following description when read in conjunction with the accompanying drawings.

BRIEF DESCRIPTION OF THE DRAWINGS

It should be noted that like reference characters are used throughout the various views of the Drawings.

DETAILED DESCRIPTION OF THE INVENTION

Figure 1:
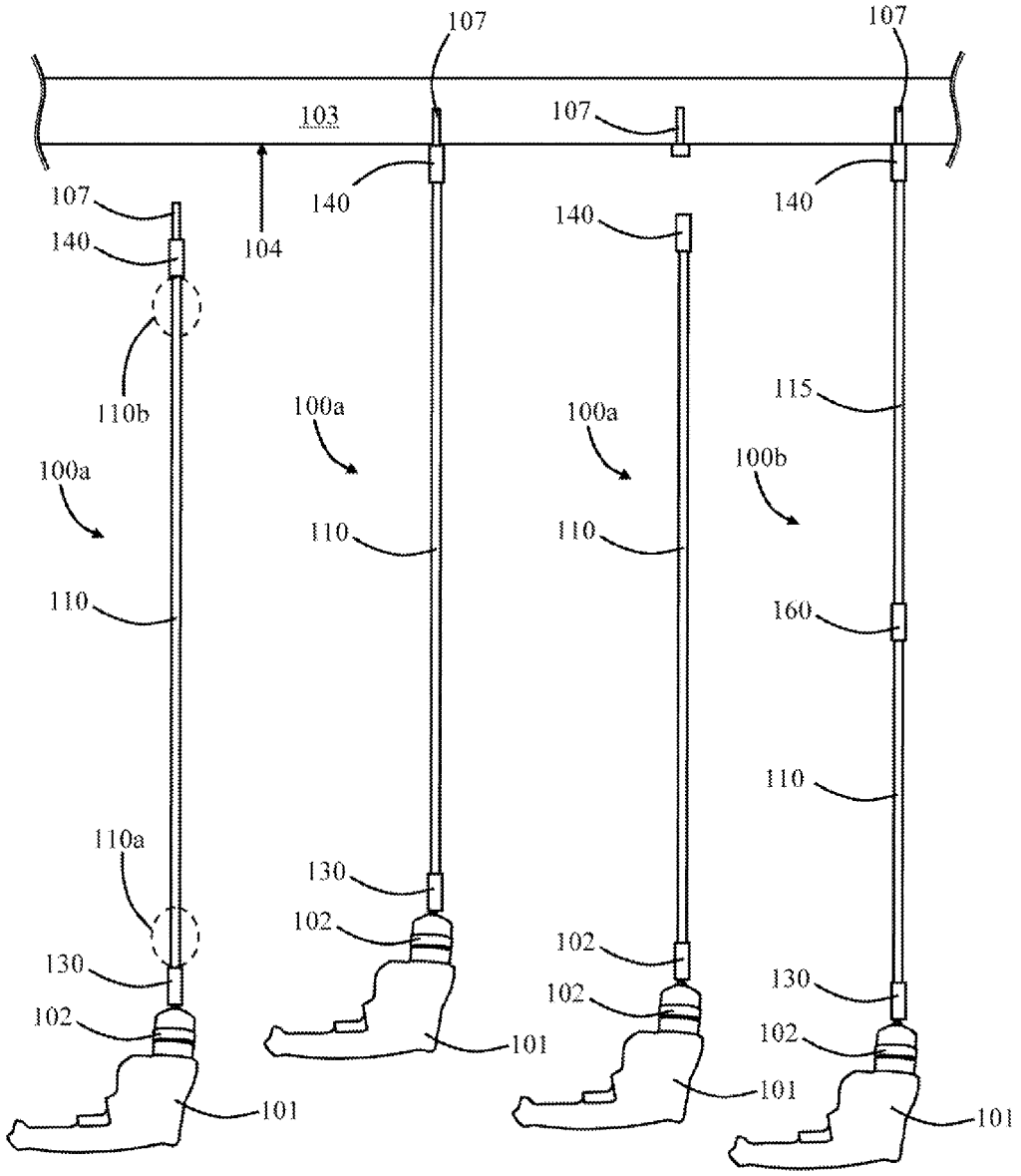
FIG. 1 is a perspective view of various embodiments of a pole assembly.

FIG. 1 is a perspective view of various embodiments of a pole assembly, denoted as pole assemblies 100*a* and 100*b*. In these embodiments, pole assemblies 100*a* and 100*b* are operatively coupled to a drill 101 through a drill chuck 102. Pole assemblies 100*a* and 100*b* rotate in response to the rotation of drill chuck 102. Pole assemblies 100*a* and 100*b* are used to hoist a fastener 107 so it can be extending through a surface 104 and fastened to a ceiling 103.

In this embodiment, pole assembly 100*a* includes a conduit 110, and a chuck 130 and socket piece 140 coupled to opposed proximal and distal ends 110*a* and 110*b* of conduit 110. Proximal end 110*a* is coupled to drill chuck 102, and distal end 110*b* is positioned away from drill chuck 102.

Figure 2A:
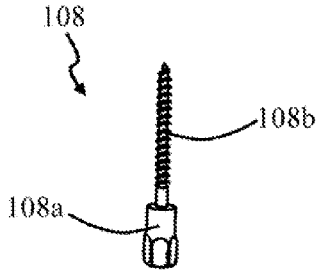
FIGS. 2*a* and 2*b* are perspective views of wood and concrete fasteners, respectively.
Figure 2B:
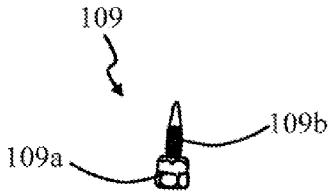

Fastener 107 can be of many different types of fasteners. FIGS. 2*a* and 2*b* are perspective views of wood and concrete fasteners 108 and 109, respectively. Wood fastener 108 includes a head 108*a* and a threaded shaft 108*b* extending therefrom. Wood fastener 108 is designed to be fastened to wood, such as when ceiling 103 includes wood and surface 104 corresponds to a wood surface. Concrete fastener 109 is designed to be fastened to concrete, such as when ceiling 103 includes concrete and surface 104 corresponds to a concrete surface. It should be noted that fastener 107 can be many other different types of objects, such as a wire, threaded and smooth rods, a jack chain and a J-hook.

Figure 3:
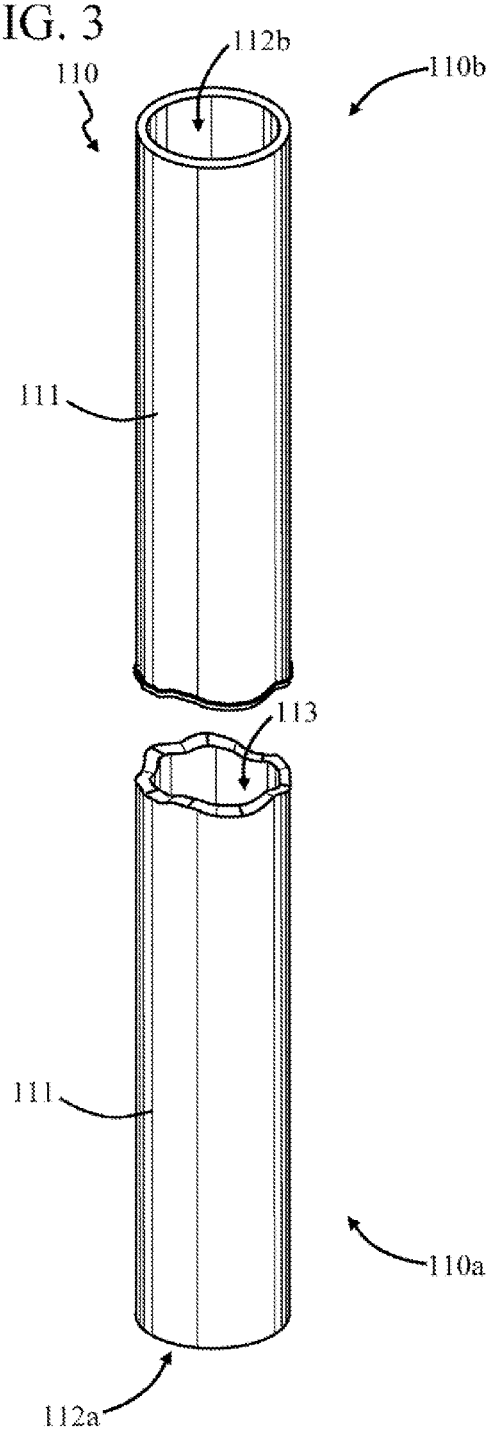
FIG. 3 is a perspective view of a conduit.

FIG. 3 is a perspective view of conduit 110. Conduit 110 can be of many different types, such as electrical conduit used to protect and route electrical wiring. In this embodiment, conduit 110 includes a conduit body 111 with a conduit body channel 113 extending therethrough. Conduit body channel 113 extends between a proximal conduit body opening 112*a* and distal conduit body opening 112*b*. Proximal conduit body opening 112*a* and distal conduit body opening 112*b* are positioned at proximal end 110*a* and distal end 110*b*, respectively, of conduit 110. Conduit 110 can be coupled to chuck 130 and socket piece 140 in many different ways, one of which will be discussed in more detail presently.

It should be noted that pole assembly 100*b* of FIG. 1 includes a conduit 115, which can be the same or similar to conduit 110. In some embodiments conduits 110 and 115 have the same lengths and, in other embodiments, conduits 110 and 115 have different lengths. Conduit 115 includes a conduit body 116 with a conduit body channel extending therethrough. The conduit body channel extends between a proximate conduit end 115*a* and distal conduit end 115*b*.

Figure 4A:
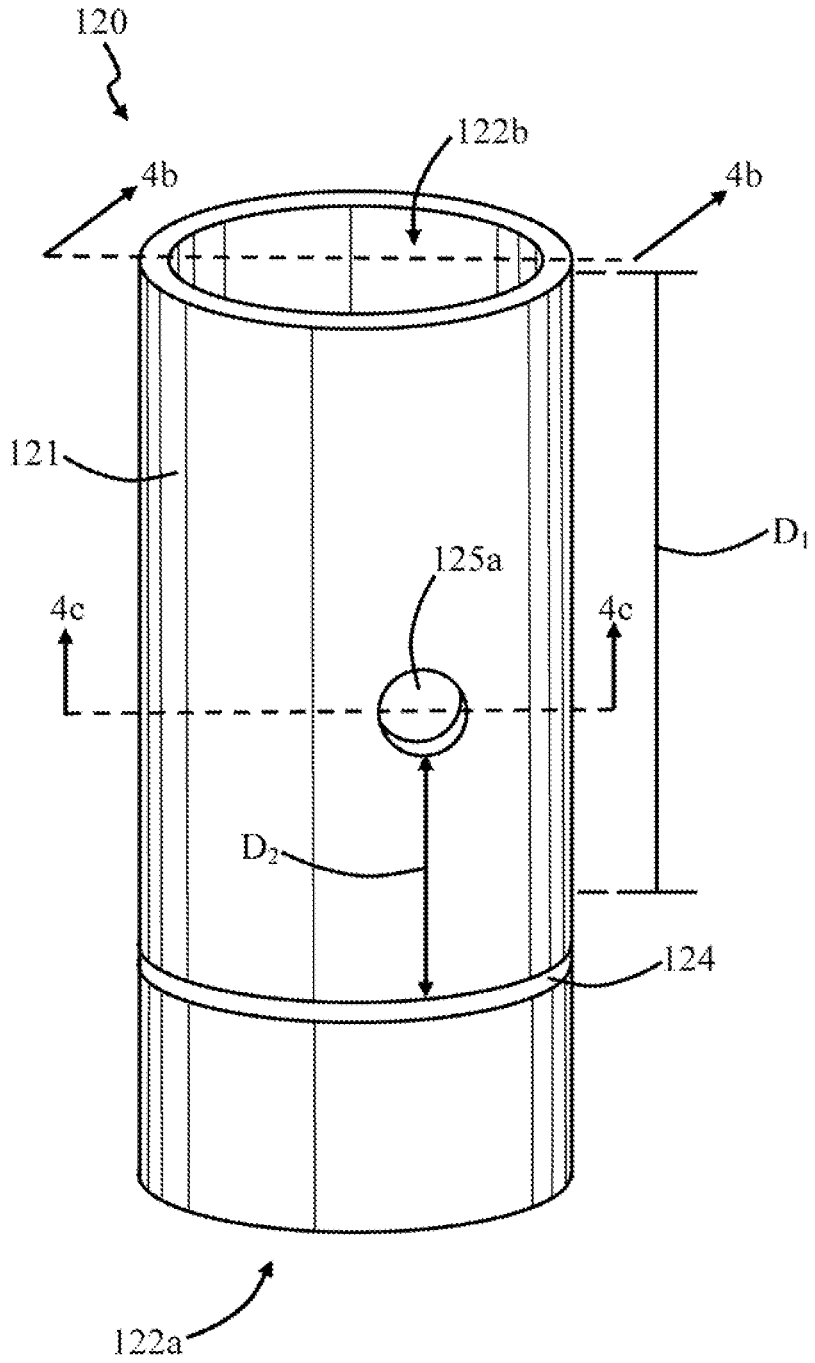
FIG. 4*a* is a perspective view of a template used to form a fastener opening at a desired location.
Figure 4B:
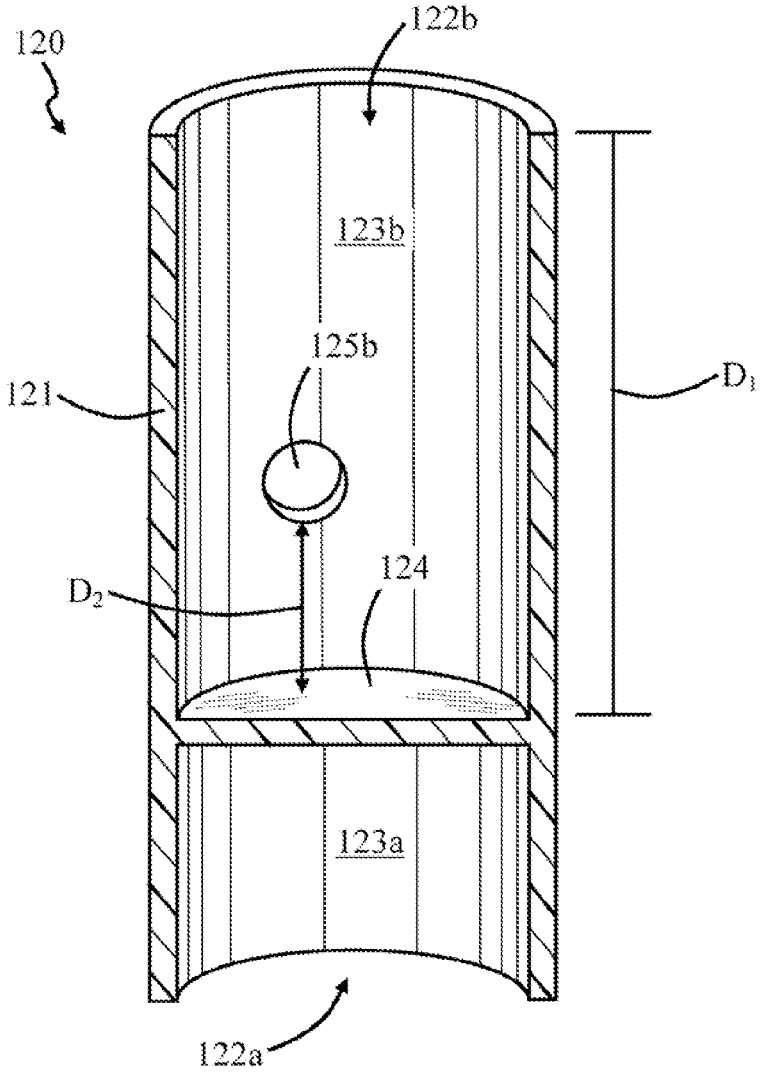
FIG. 4*b* is a cut-away perspective view of the template of FIG. 4*a* taken along a cut-line 4*b*-4*b* of FIG. 4*a*.

FIG. 4*a* is a perspective view of a template 120 used to form a fastener opening at a desired location, such as with conduit 110. FIG. 4*b* is a cut-away perspective view of template 120 taken along a cut-line 4*b*-4*b* of FIG. 4*a*, and FIG. 4*c* is a cut-away perspective view of template 120 taken along a cut-line 4*c*-4*c* of FIG. 4*a*.

In this embodiment, template 120 includes a template body 121, and proximal template body opening 122*a* and distal template body opening 122*b* at opposed ends. A template body channel 123*a* extends through template body 121 and between template body opening 122*a* and a template stop piece 124. A template body channel 123*b* extends through template body 121 and between template body opening 122*b* and template stop piece 124. A distance between template body opening 122*b* and template stop piece 124 is denoted as distance $D_1$ in FIGS. 4*a* and 4*b*.

Template 120 includes opposed fastener openings 125*a* and 125*b*, which extend through template body 121. Fastener openings 125*a* and 125*b* are positioned opposed to each other, as shown in FIG. 4*c*, so that an object, such as a fastener, can be extended through them. A distance between stop piece 124 and a bottom portion of fastener opening 125*a* is denoted as distance $D_2$ in FIG. 4*a*. Further, a distance between stop piece 124 and a bottom portion of fastener opening 125*b* is denoted as distance $D_2$ in FIG. 4*b*. In this way, the bottom portions of fastener openings 125*a* and 125*b* are positioned the same distance from stop piece 124.

Figure 4C:
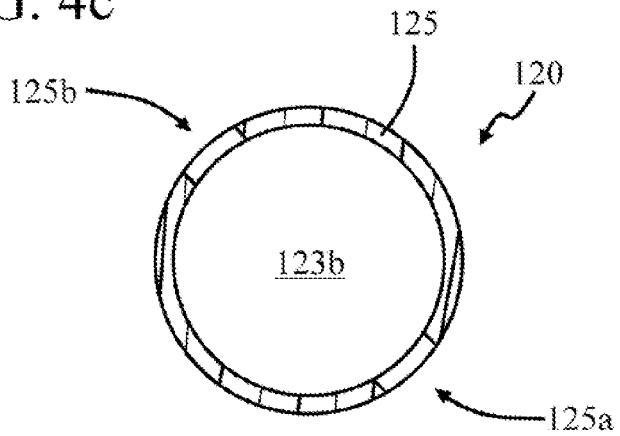
FIG. 4*c* is a cut-away perspective view of the template of FIG. 4*a* taken along a cut-line 4*c*-4*c* of FIG. 4*a*.
Figure 5A:
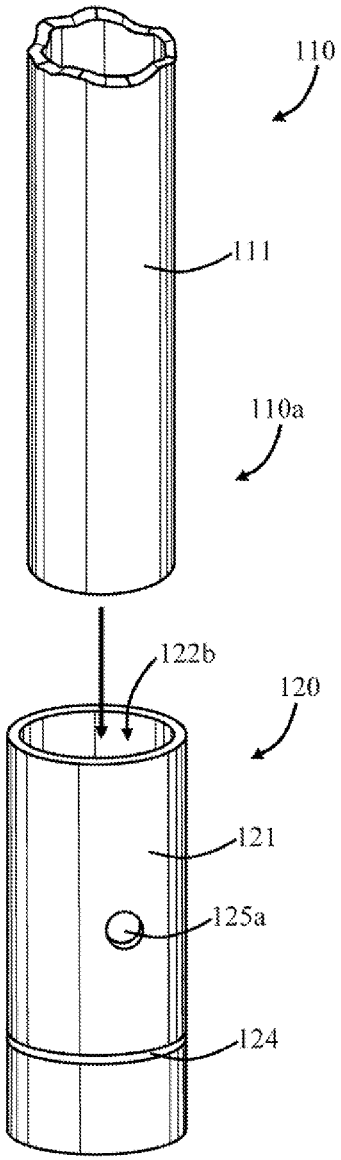
FIGS. 5*a*, 5*b* and 5*c* are perspective views of a fastener opening being formed through a proximal end of the conduit of FIG. 2 using the template of FIGS. 4*a*-4*c*.
Figure 5B:
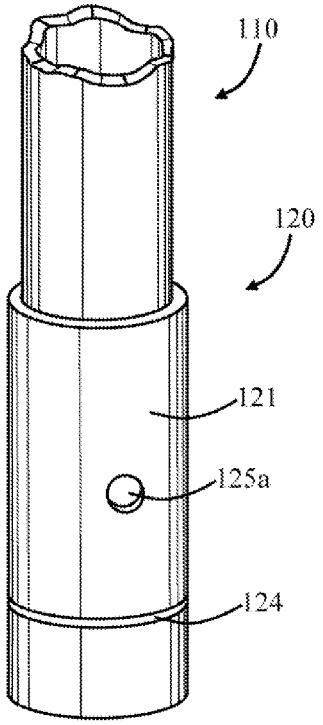
Figure 5C:
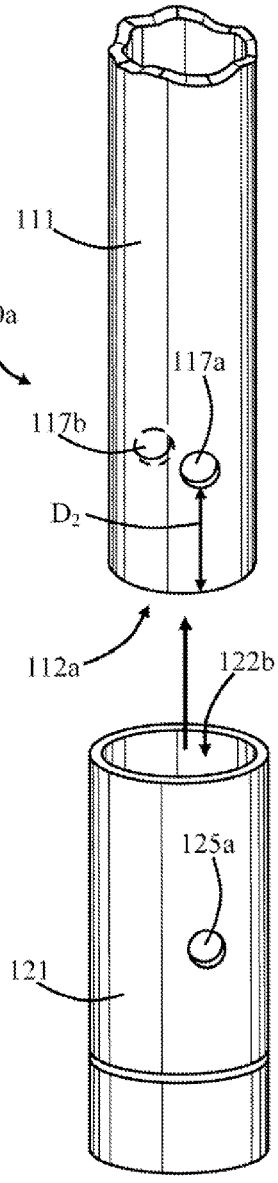

FIGS. 5*a*, 5*b* and 5*c* are perspective views of conduit fastener openings 117*a* and 117*b* (FIG. 5*c*) being formed through proximal end 110*a* of the conduit 110 of FIG. 2 using template 120 of FIGS. 4*a*-4*c*. Conduit fastener openings 117*a* and 117*b* are used to couple proximal end 110*a* of conduit 110 to another piece, such as chuck 130. In operation, proximal end 110*a* is moved through template body opening 122*b* and template body channel 123*b* so it engages template stop piece 124. As mentioned above, the distance between template body opening 122*b* and template stop piece 124 is distance $D_1$. Hence, a length of conduit 110 which extends through template body channel 123*b* corresponds to distance $D_1$. A drill bit (not shown) is extended through fastener openings 125*a* and 125*b* and proximal end 110*a* of conduit 110 to form conduit fastener openings 117*a* and 117*b* (FIG. 5*c*), wherein a bottom portion of conduit fastener openings 117*a* and 117*b* are positioned distance $D_1$ from proximal conduit body opening 112*a*. In this way, conduit fastener openings 117*a* and 117*b* are formed at a desired location with conduit 110. It should be noted that template 120 typically includes a hardened metal material, such as tool steel, so that fastener openings 125*a* and 125*b* resist being worn out in response to extending the drill bit therethrough.

Figure 6A:
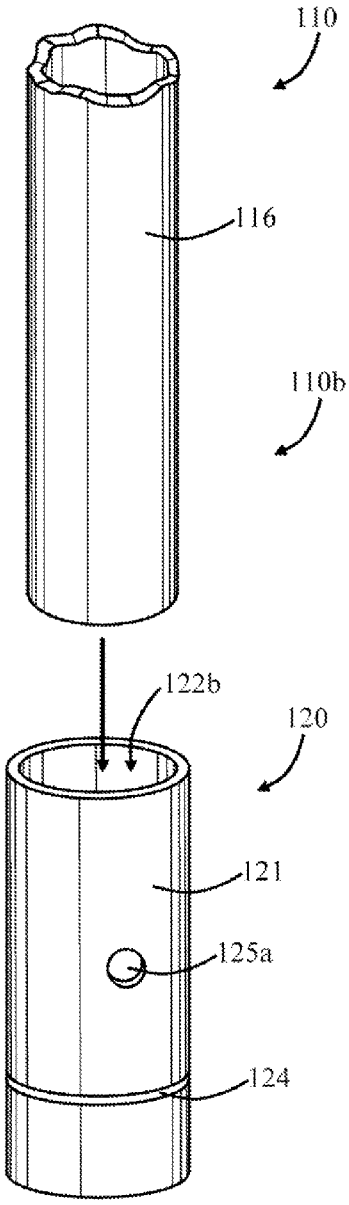
FIGS. 6*a*, 6*b* and 6*c* are perspective views of a fastener opening being formed through a distal end of the conduit of FIG. 2 using the template of FIGS. 4*a*-4*c*.
Figure 6B:
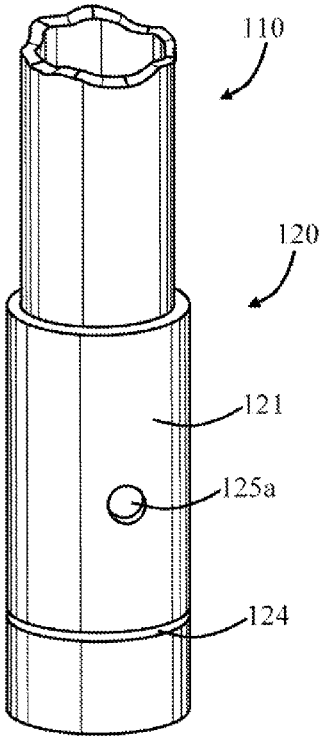
Figure 6C:
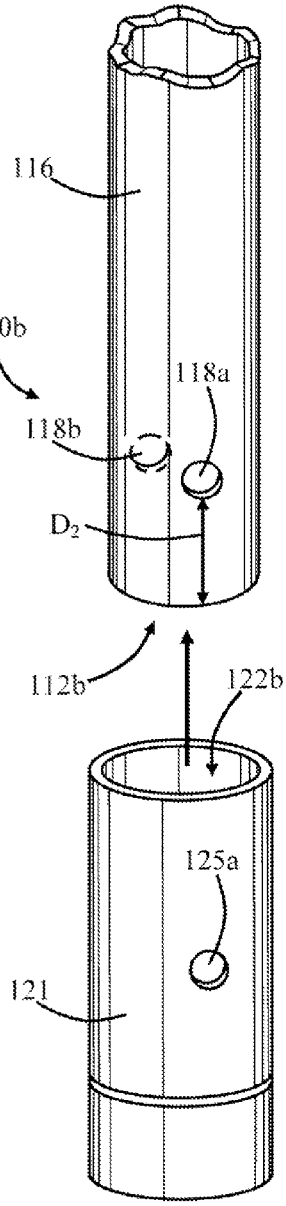

FIGS. 6*a*, 6*b* and 6*c* are perspective views of conduit fastener openings 118*a* and 118*b* (FIG. 6*c*) being, formed through distal end 110*b* of the conduit 110 of FIG. 2 using template 120 of FIGS. 4*a*-4*c*. Conduit fastener openings 118*a* and 118*b* are used to couple distal end 110*b* of conduit 110 to another piece, such as socket piece 140. In operation, distal end 110*b* is moved through template body opening 122*b* and template body channel 123*b* so it engages template stop piece 124. As mentioned above, the distance between template body opening 122*b* and template stop piece 124 is distance $D_1$. Hence, a length of conduit 110 which extends through template body channel 123*b* corresponds to distance $D_1$. A drill bit (not shown) is extended through fastener openings 125*a* and 125*b* and distal end 110*b* of conduit 110 to form conduit fastener openings 118*a* and 118*b* (FIG. 6*c*), wherein a bottom portion of conduit fastener openings 118*a* and 118*b* are positioned distance $D_1$ from distal conduit body opening 112*b*. In this way, conduit fastener openings 118*a* and 118*b* are formed at a desired location with conduit 110.

Figure 7A:
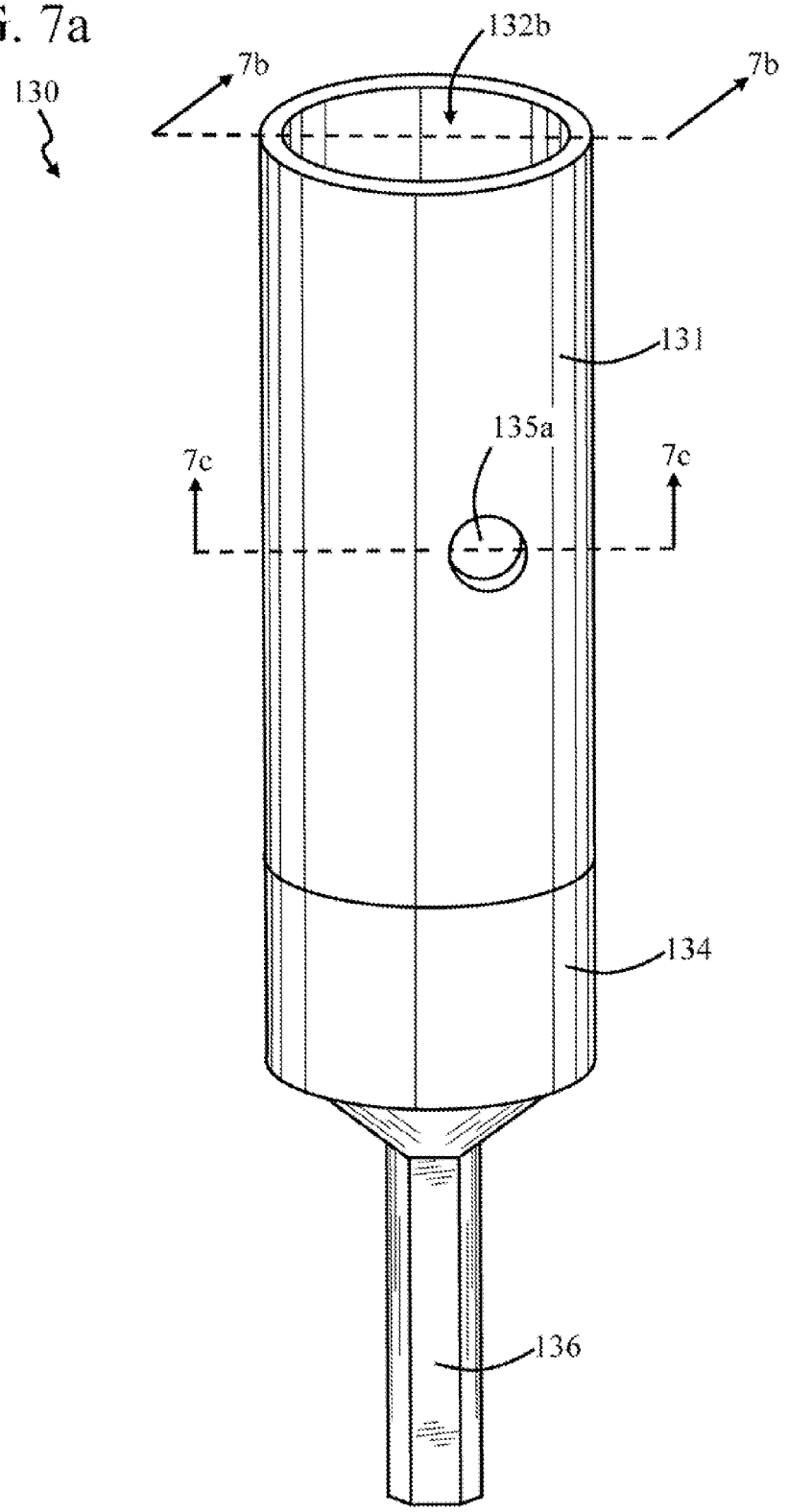
FIG. 7*a* is a perspective view of a chuck used to couple the conduit of FIGS. 5*a*-5*c* and FIGS. 6*a*-6*c* to a drill, as shown in FIG. 1.
Figure 7B:
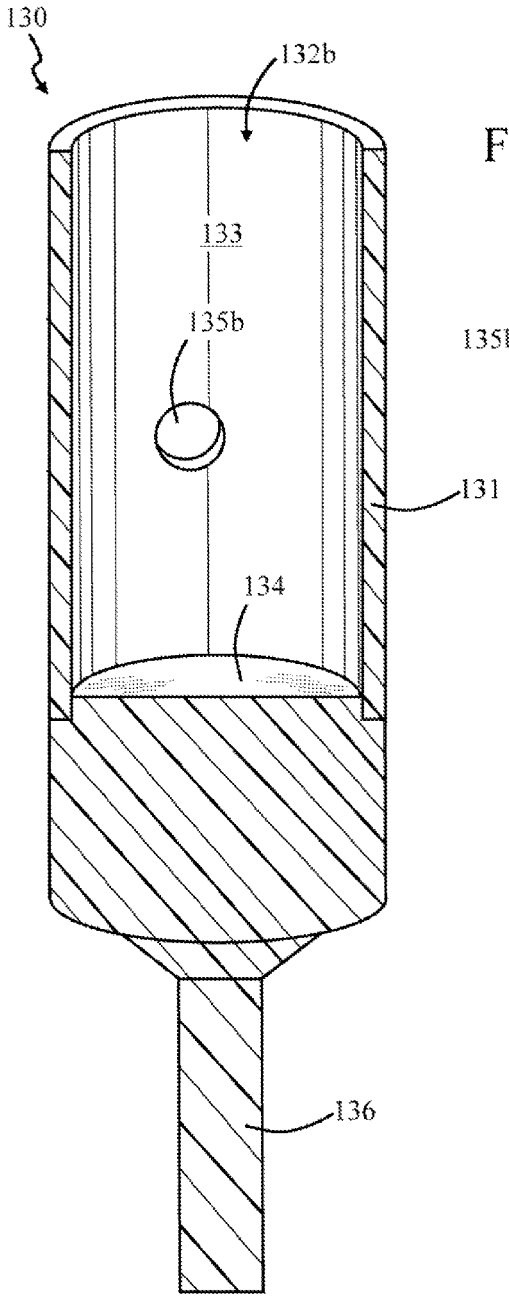
FIG. 7*b* is a cut-away perspective view of the chuck of FIG. 7*a* taken along a cut-line 7*b*-7*b* of FIG. 7*a*.
Figure 7C:
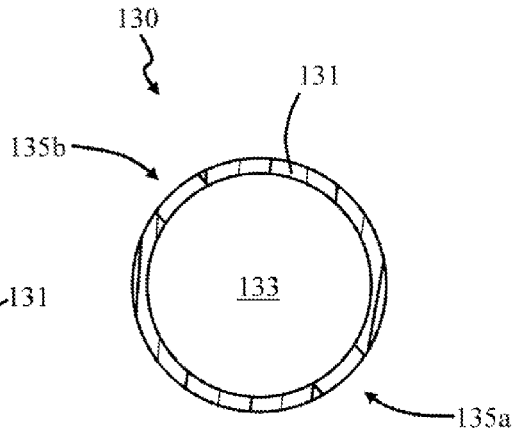
FIG. 7*c* is a cut-away perspective view of the chuck of FIG. 7*a* taken along a cut-line 7*c*-7*c* of FIG. 7*a*.

FIG. 7*a* is a perspective view of one embodiment of chuck 130, which is used to couple conduit 120 of FIGS. 5*a*-5*c* and FIGS. 6*a*-6*c* to drill 101, as shown in FIG. 1. FIG. 7*b* is a cut-away perspective view of chuck 130 taken along a cut-line 7*b*-7*b* of FIG. 7*a*, and FIG. 7*c* is a cut-away perspective view of chuck 130 taken along a cut-line 7*c*-7*c* of FIG. 7*a*.

In this embodiment, chuck 130 includes a chuck body 131, and a distal chuck body opening 132*b* at one end. Distal chuck body opening 132*b* is sized and shaped to receive proximate conduit end 110*a* of conduit 110. A chuck body channel 133 extends through chuck body 131 and between distal chuck body opening 132*b* and a chuck stop piece 134. Chuck 130 includes a shank 136 which extends away from distal chuck body opening, 132*b* and chuck stop piece 134. Shank 136 is extended through the drill chuck 102 of drill 101, as shown in FIG. 1.

Chuck 130 includes opposed fastener openings 135*a* and 135*b*, which extend through chuck body 131. Fastener openings 135*a* and 135*b* are positioned opposed to each other, as shown in FIG. 7*c*, so that an object, such as a fastener, can be extended through them. Further, fastener openings 135*a* and 135*b* are positioned so that conduit fastener openings 117*a* and 117*b* are aligned with fastener openings 135*a* and 135*b*, respectively, when proximate conduit end 110*a* of conduit 110 is extended through distal chuck body opening 132*b*. In this way, a fastener (not shown) can be extended through fastener openings 135*a* and 135*b* and conduit fastener openings 117*a* and 117*b* so that chuck 130 and proximate conduit end 110*a* of conduit 110 are coupled together, as shown in FIG. 1.

Figure 8A:
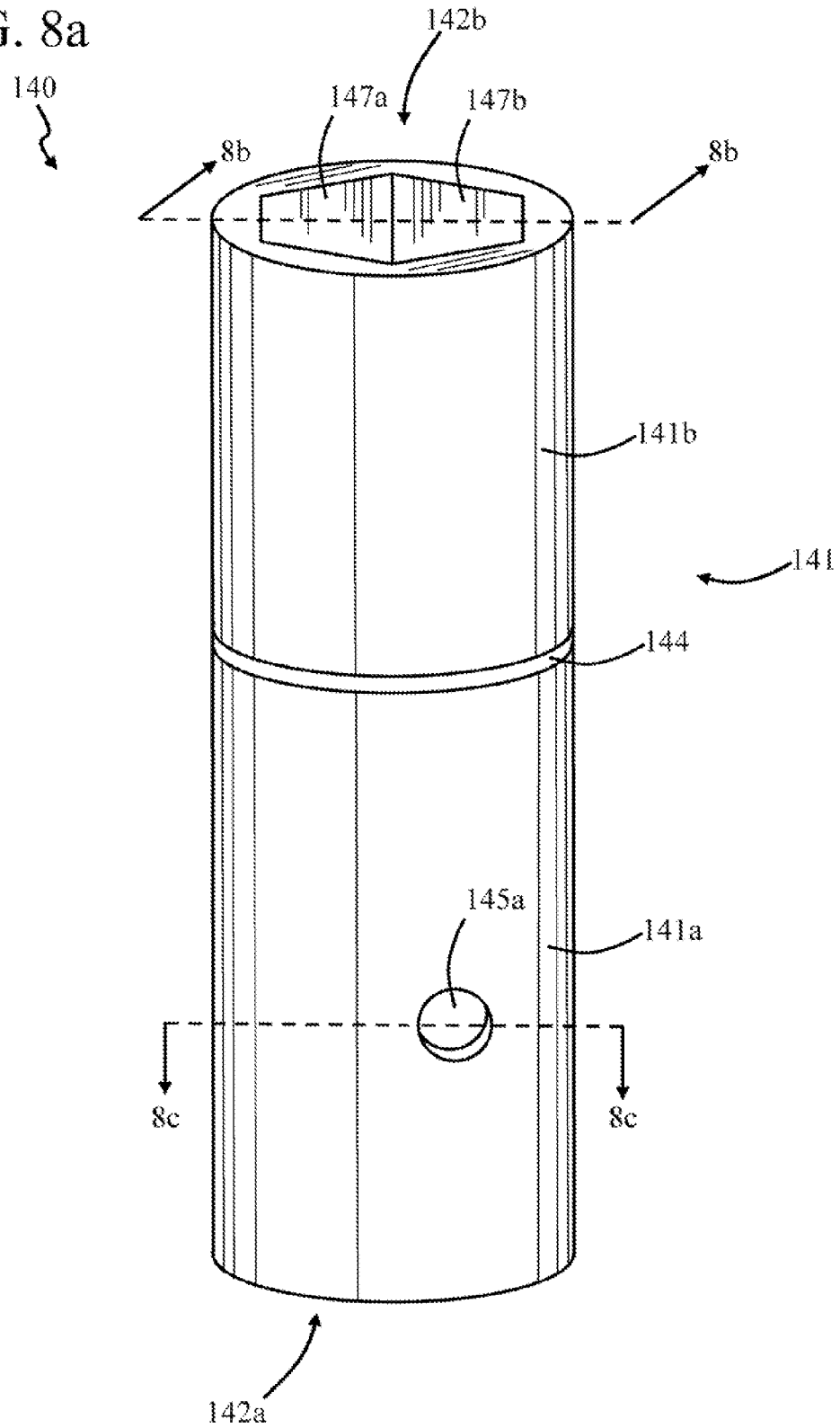
FIG. 8*a* is a perspective view of a socket piece used to couple a fastener to the conduit of FIGS. 5*a*-5*c* and FIGS. 6*a*-6*c*, as shown in FIG. 1.
Figure 8B:
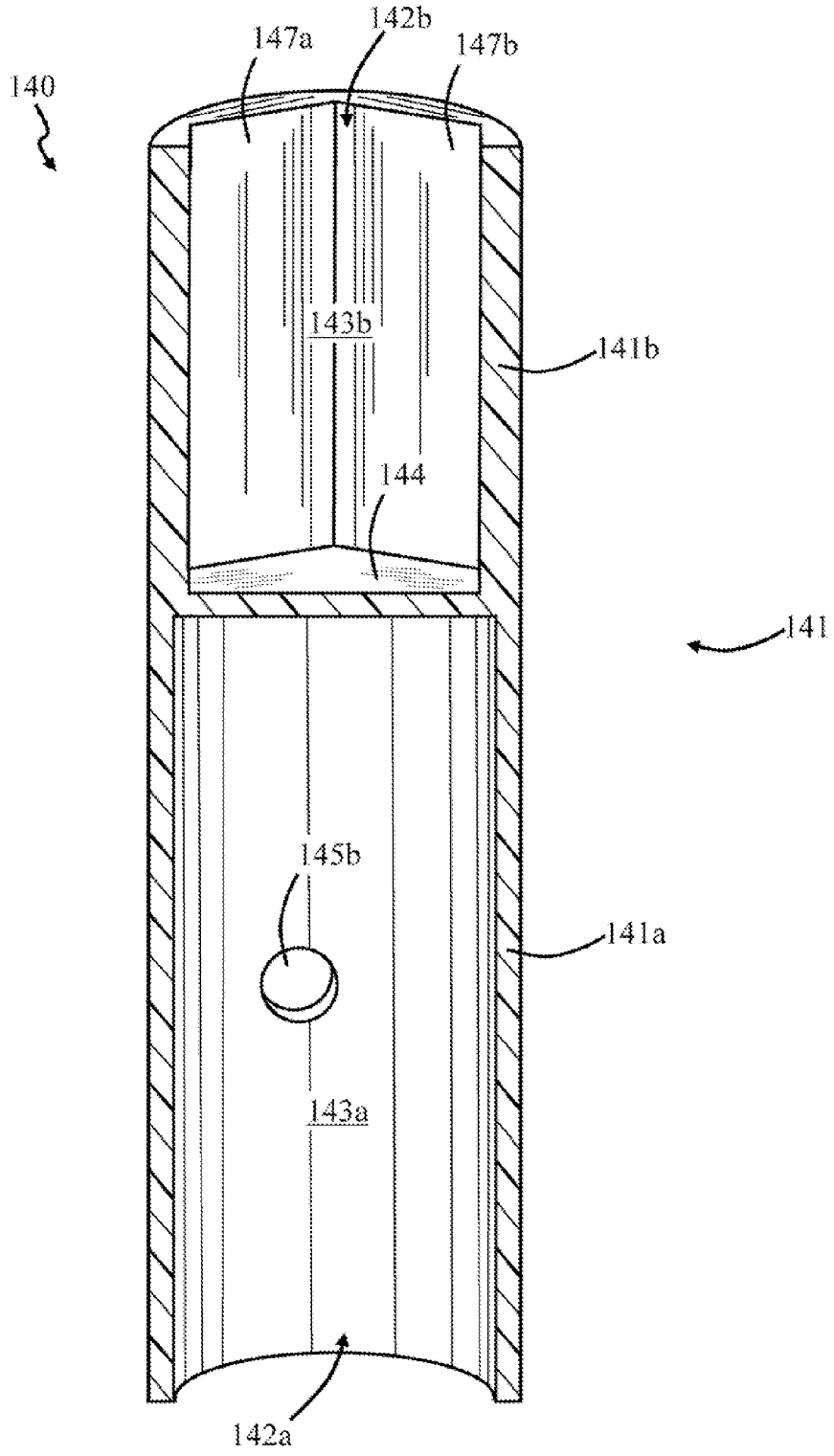
FIG. 8*b* is a cut-away perspective view of the socket piece of FIG. 8*a* taken along a cut-line 8*b*-8*b* of FIG. 8*a*.
Figure 8C:
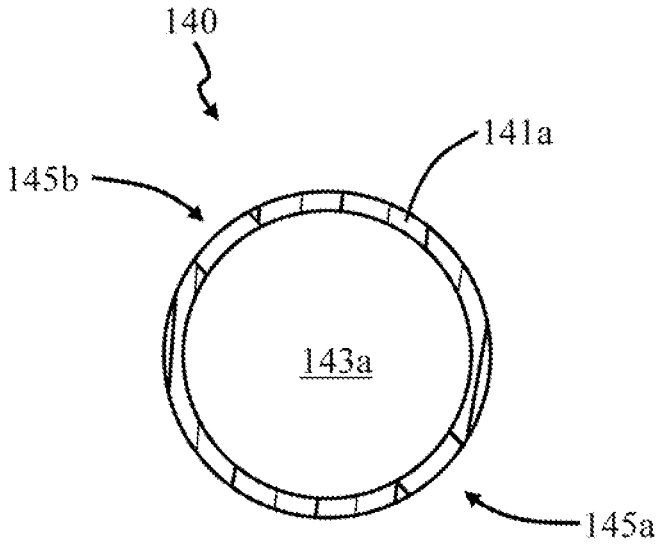
FIG. 8*c* is a cut-away perspective view of the socket piece of FIG. 8*a* taken along a cut-line 8*c*-8*c* of FIG. 8*a*.
Figure 8D:
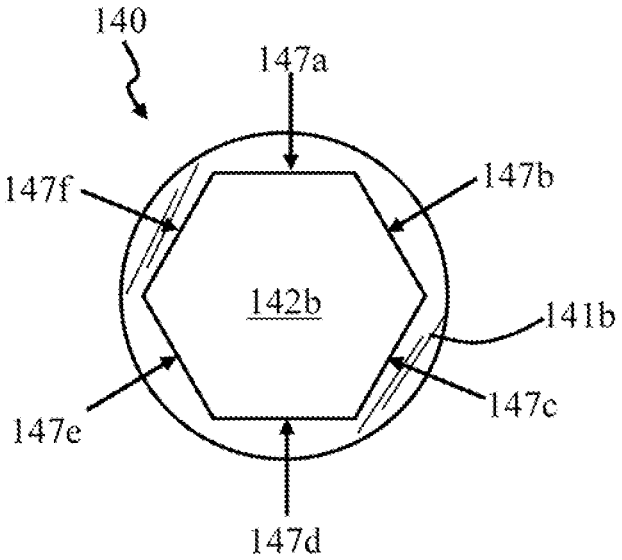
FIG. 8*d* is a top view of the socket piece of FIG. 8*a* showing a socketed body opening.

FIG. 8*a* is a perspective view of one embodiment of socket piece 140, which is used to couple fastener 107 to conduit 110 of FIGS. 5*a*-5*c* and FIGS. 6*a*-6*c*, as shown in FIG. 1. FIG. 8*b* is a cut-away perspective view of socket piece 140 of FIG. 8*a* taken along a cut-line 8*b*-8*b* of FIG. 8*a*, and FIG. 8*c* is a cut-away perspective view of socket piece 140 of FIG. 8*a* taken along a cut-line 8*c*-8*c* of FIG. 8*a*. FIG. 8*d* is a top view of a socket piece of FIG. 8*a* showing a socketed body opening 142*b*.

In this embodiment, socket piece 140 includes a socket piece body 141 having a conduit fitting body 141*a* and socket fitting body 141*b*. An unsocketed body opening 142*a* extends through conduit fitting body 141*a*, and an unsocketed body channel 143*a* extends through conduit fitting body 141*a* and between unsocketed body opening 142*a* and a socket stop piece 144. Unsocketed body opening 142*a* is sized and shaped to receive distal conduit end 110*b* of conduit 110. Body channel 143*a* is unsocketed because it does not include a facet.

A socketed body opening 142*b* extends through socket fitting body 141*b*, and a socketed body channel 143*b* extends through socket fitting body 141*b* and between socketed body opening 142*b* and socket stop piece 144. Channel body 143*b* is socketed because it includes a facet, which are denoted as facets 147*a*, 147*b*, 147*c*, 147*d*. 147*e* and 147*f* in FIG. 8*d*. It should be noted that six facets are shown in FIG. 8*d* for illustrative purposes. In general, channel body 143*b* is socketed because it includes one or more facets. Socketed body opening 142*b* is sized and shaped to receive a fastener, such as fastener 107 of FIG. 1, or fasteners 108 and 109 of FIGS. 2*a* and 2*b*, respectively. It should be noted that the number of facets of channel body 143*b* is chosen to match the number of facets of head 108*a* or head 109*a*. In this way, heads 108*a* and 109*a* are capable of extending through socketed body opening 142*b* and socketed body channel 143*b*. Channel body 143*b* is faceted so that the fastener received by socketed body opening 142*b* rotates in response to the rotation of socket piece 140.

Socket piece 140 includes opposed fastener openings 145*a* and 145*b*, which extend through socket piece body 141. Fastener openings 145*a* and 145*b* are positioned opposed to each other, as shown in FIG. 8*c*, so that an object, such as a fastener, can be extended through them. Further, fastener openings 145*a* and 145*b* are positioned so that conduit fastener openings 118*a* and 118*b* are aligned with fastener openings 145*a* and 145*b*, respectively, when distal conduit end 110*b* of conduit 110 is extended through unsocketed body opening 142*a*. In this way, a fastener (not shown) can be extended through unsocketed body opening 142*a* and conduit fastener openings 118*a* and 118*b* so that socket piece 140 and distal conduit end 110*b* of conduit 110 are coupled together, as shown in FIG. 1.

Figure 9:
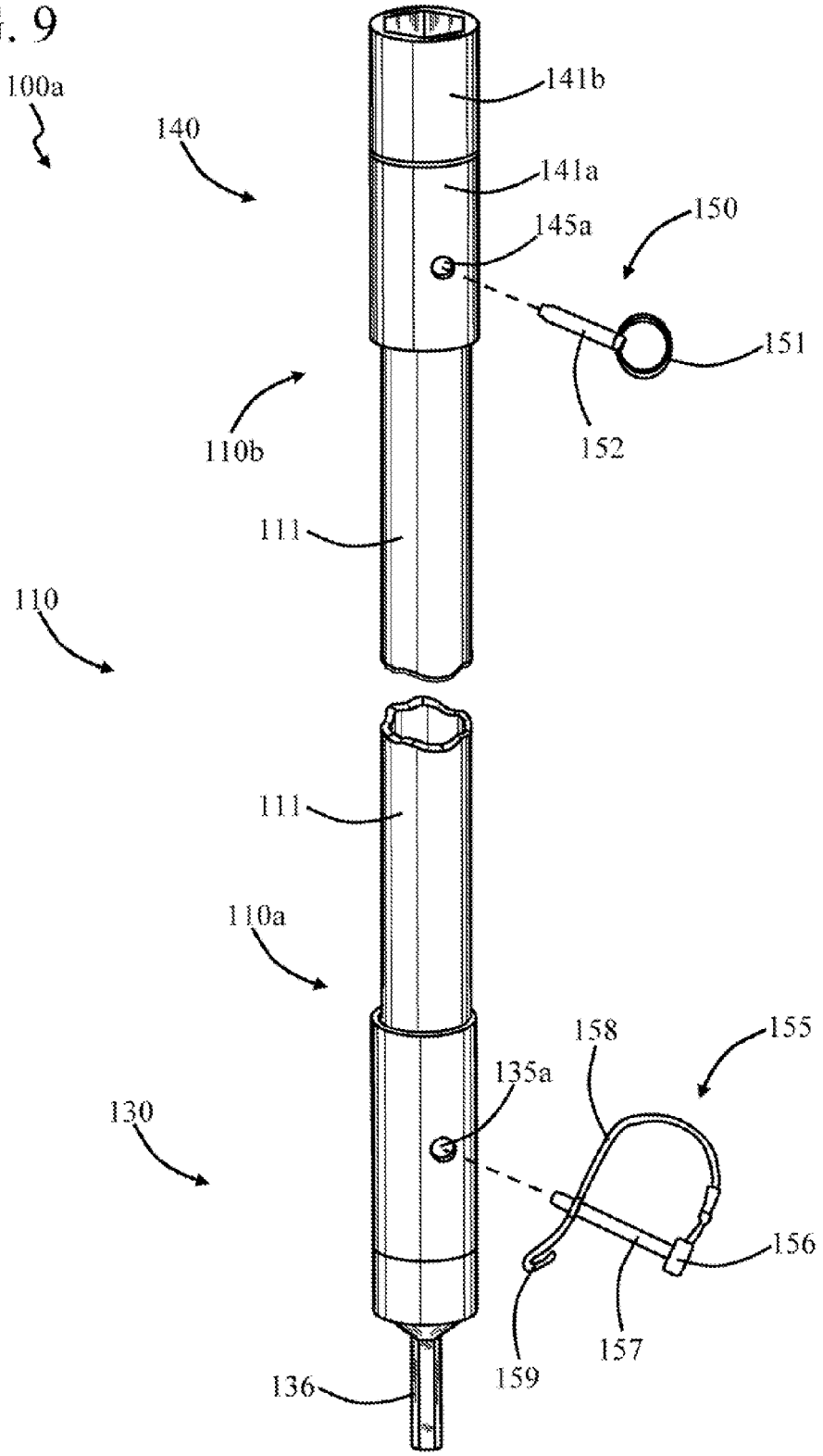
FIG. 9 is a perspective view of one embodiment of the pole assembly of FIG. 1.

FIG. 9 is a perspective view of one embodiment of pole assembly 100*a* of FIG. 1. In this embodiment, chuck 130 is coupled to proximal end 110*a* of conduit 110 by using a locking pin 155. It should be noted, however, that chuck 130 and proximal end 110*a* of conduit 110 can be coupled together in many different ways, such as by using various pins and fasteners. In this embodiment, locking pin 155 includes a pin head 156 with a pin shank 157 extending therefrom. Pin shank 157 extends through fastener openings 135*a* and 135*b*, as well as through conduit fastener openings 117*a* and 117*b*. Locking pin 155 includes a loop 158 coupled to pin head 156, and loop 158 includes a locking loop 159 at a distal end thereof. Locking loop 159 can be locked to the distal end of pin shank 157 to hold locking pin 144 in place. In this way, chuck 130 and the proximal end 110*a* of conduit 110 are coupled together with a locking pin.

In this embodiment, socket piece 140 is coupled to distal end 110*b* of conduit 110 by using a pin 150. It should be noted, however, that socket piece 140 and distal end 110*b* of conduit 110 can be coupled together in many different ways, such as by using various pins and fasteners. In this embodiment, pin 150 includes a pin ring 151 with a pin shank 152 extending therefrom. Pin shank 152 extends through fastener openings 145*a* and 145*b*, as well as through conduit fastener openings 118*a* and 118*b*. In this way, socket piece 140 and the distal end 110*b* of conduit 110 are coupled together with a pin.

Figure 10A:
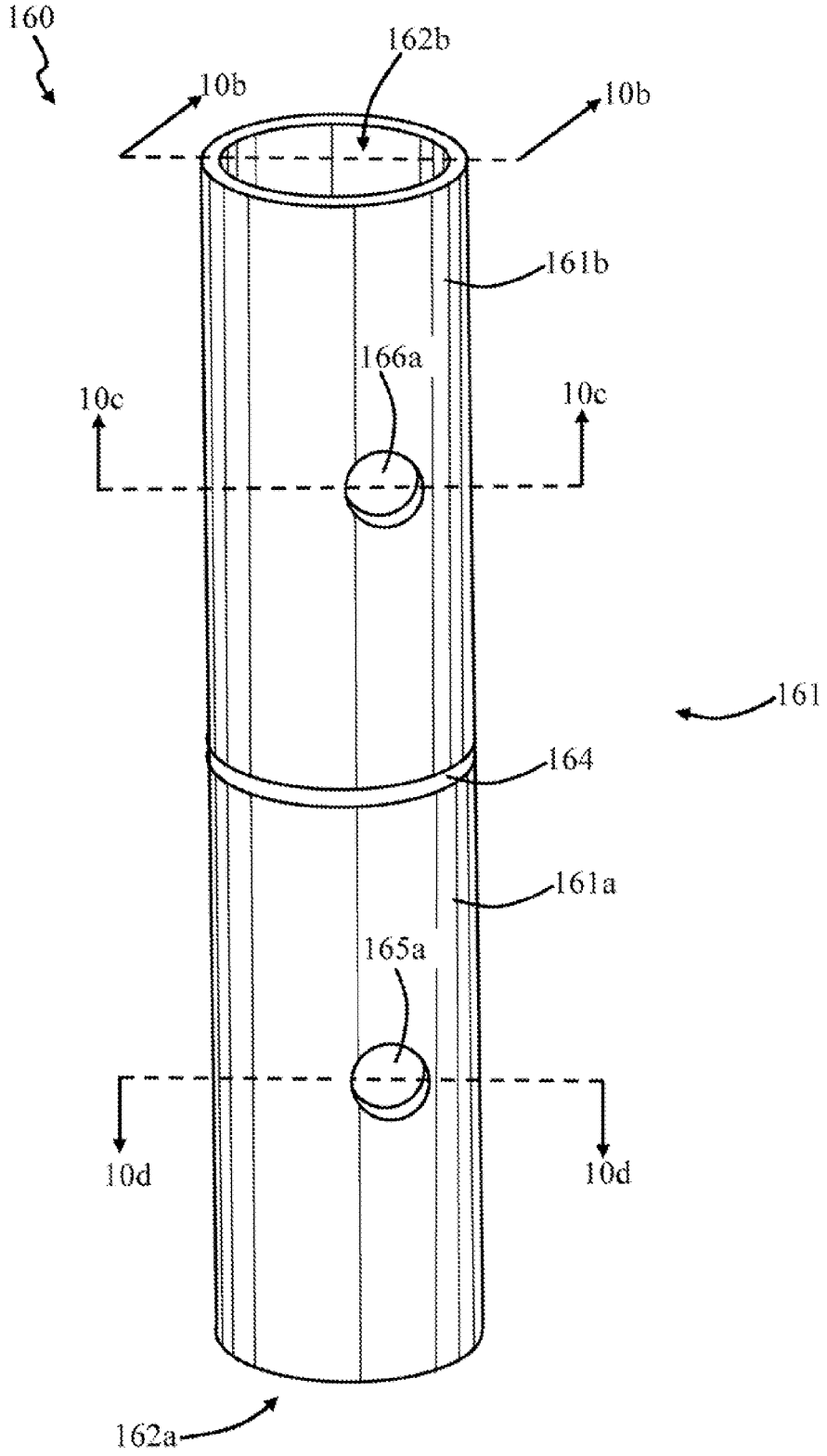
FIG. 10*a* is a perspective view of a coupler included with another embodiment of a pole assembly of FIG. 1.
Figure 10B:
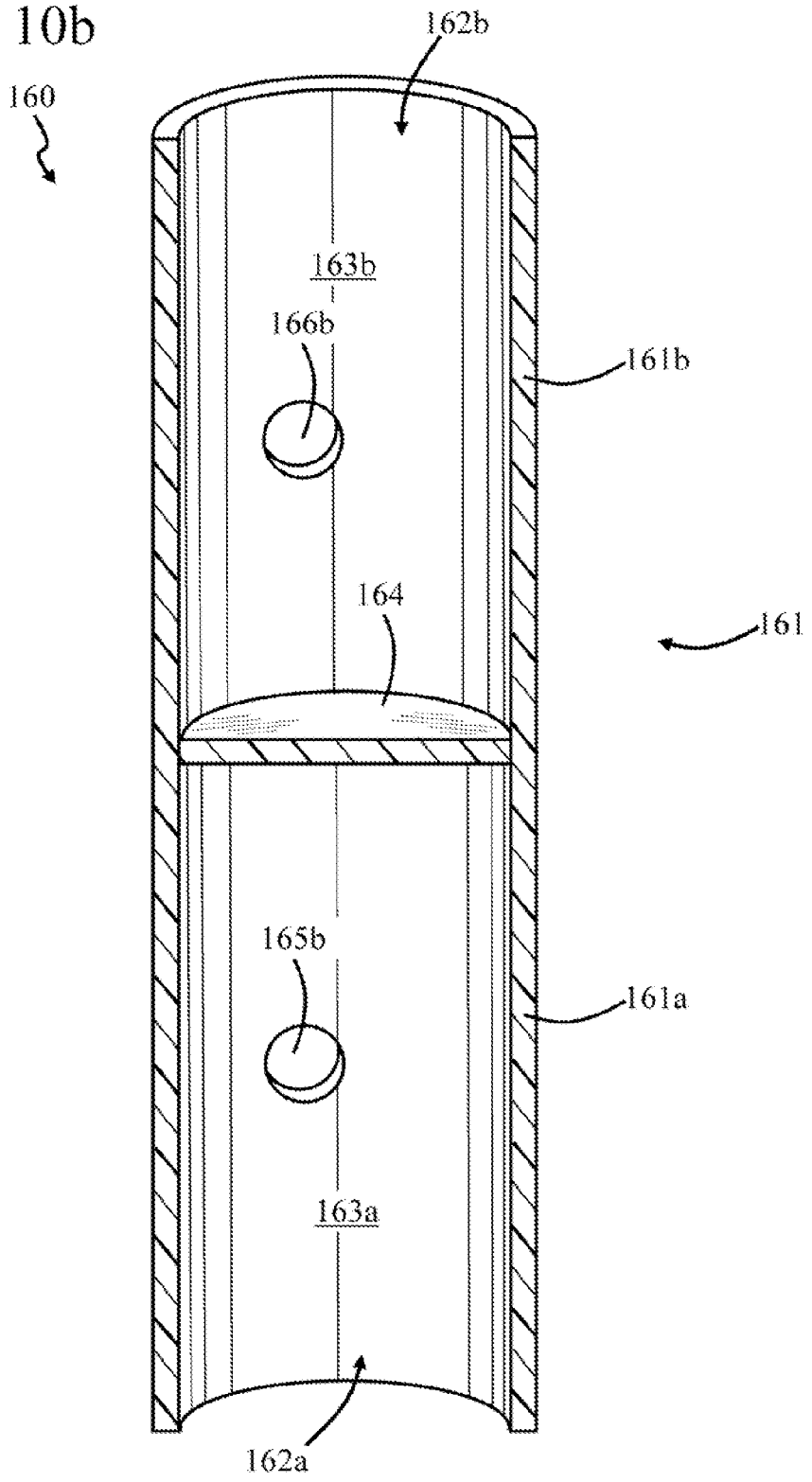
FIG. 10*b* is a cut-away perspective view of the coupler of FIG. 10*a* taken along a cut-line 10*b*-10*b* of FIG. 10*a*.
Figure 10C:
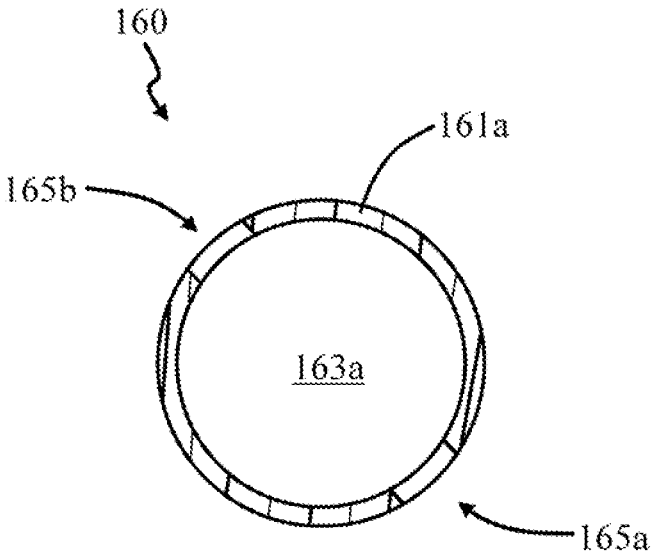
FIG. 10*c* is a cut-away perspective view of the coupler of FIG. 10*a* taken along a cut-line 10*c*-10*c* of FIG. 10*a*.
Figure 10D:
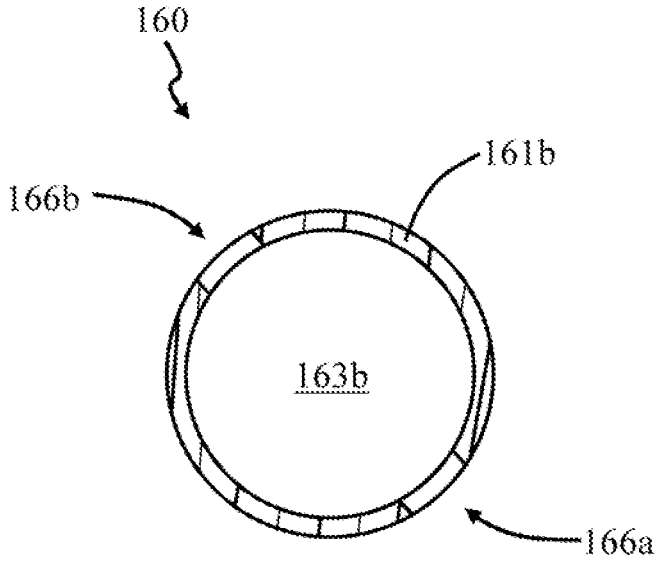
FIG. 10*d* is a cut-away perspective view of the coupler of FIG. 10*a* taken along a cut-line 10*d*-10*d* of FIG. 10*a*.

FIG. 10*a* is a perspective view of a coupler 160 included with pole assembly 100*b* of FIG. 1. FIG. 10*b* is a cut-away perspective view of coupler 160 taken along a cut-line 10*b*-10*b* of FIG. 10*a*, and FIG. 10*c* is a cut away perspective view of coupler 160 taken along a cut-line 10*c*-10*c* of FIG. 10*a*. FIG. 10*d* is a cut-away perspective view of coupler 160 taken along a cut-line 10*d*-10*d* of FIG. 10*a*.

In this embodiment, coupler 160 includes a coupler body 161 having a proximal conduit fitting body 161*a* and distal conduit fitting body 161*b*. Coupler 160 includes a proximal coupler opening 162*a* which extends through proximal conduit fitting body 161*a* and a distal coupler opening 162*b* which extends through distal conduit fitting body 161*b*. A proximal conduit body channel 163*a* extends through proximal conduit fitting body 161*a* and between proximal coupler opening 162*a* and a coupler stop piece 164. A distal conduit body channel 163*b* extends through distal conduit fitting body 161*b* and between distal coupler opening 162*b* and coupler stop piece 164.

Coupler 160 includes opposed proximal fastener openings 165*a* and 165*b*, which extend through proximal conduit fitting body 161*a*. Proximal fastener openings 165*a* and 165*b* are positioned opposed to each other, as shown in FIG. 10*c*, so that an object, such as a fastener, can be extended through them.

Coupler 160 includes opposed distal fastener openings 166*a* and 166*b*, which extend through distal conduit fitting body 161*b*. Distal fastener openings 166*a* and 166*b* are positioned opposed to each other, as shown in FIG. 10*d*, so that an object, such as a fastener, can be extended through them.

Figure 11A:
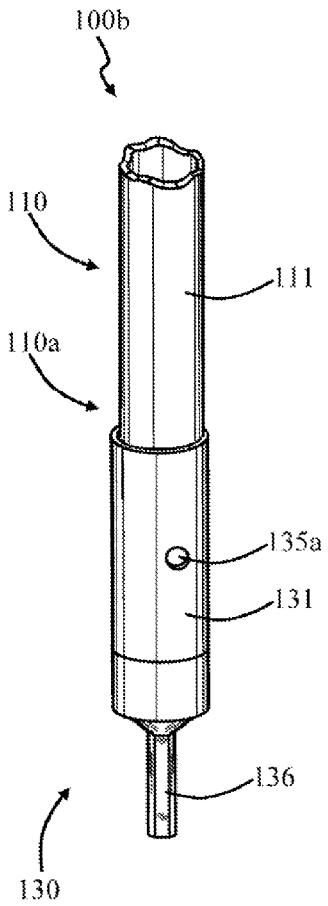
FIG. 11*a* is a perspective view of the proximal end of the embodiment of the pole assembly of FIG. 1 which includes the coupler of FIG. 10*a*.
Figure 11B:
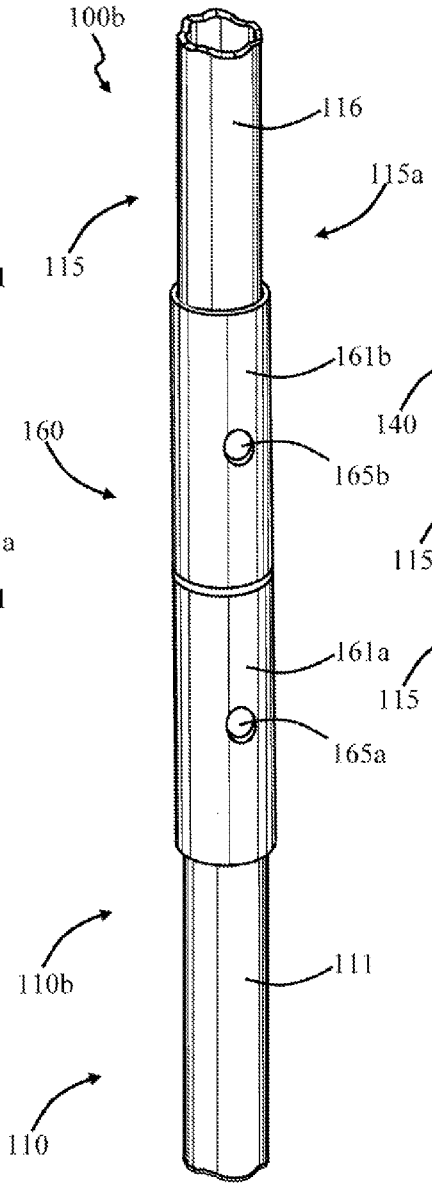
FIG. 11*b* is a perspective view of a center portion of the embodiment of the pole assembly of FIG. 1 which includes the coupler of FIG. 10*a*.
Figure 11C:
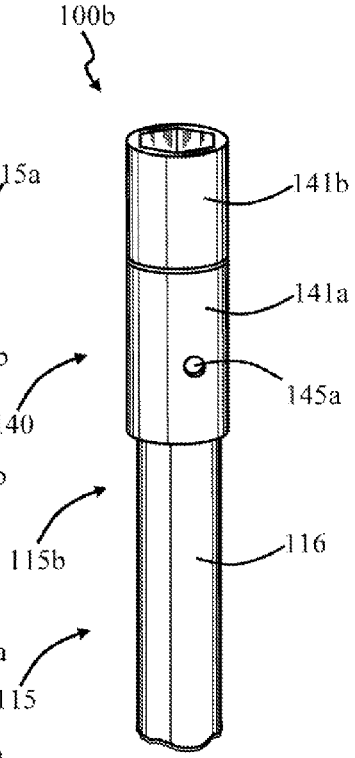
FIG. 11*c* is a perspective view of a distal end of the embodiment of the pole assembly of FIG. 1 which includes the coupler of FIG. 10*a*.

FIG. 11*a* is a perspective view of the proximal end of pole assembly 100*b* of FIG. 1, which includes coupler 160 of FIG. 10*a*. FIG. 11*b* is a perspective view of a center portion of pole assembly 100*b* of FIG. 1, which includes coupler 160 of FIG. 10*a*, and FIG. 11*c* is a perspective view of a distal end of pole assembly 100*b* of FIG. 1, which includes coupler 160 of FIG. 10*a*.

In this embodiment, pole assembly 100*b* includes chuck 130, which is discussed in more detail above. Chuck 130 is coupled to proximal end 110*a* of conduit 110 by using a locking pin (not shown), such as locking pin 150 or 155. It should be noted, however, that chuck 130 and proximal end 110*a* of conduit 110 can be coupled together in many different ways, such as by using various pins and fasteners.

In this embodiment, pole assembly 100*b* includes coupler 160, which is discussed in more detail above. Coupler 160 is coupled to a distal end 110*b* of conduit 110 by using a locking pin (not shown), such as locking pin 150 or 155. It should be noted, however, that coupler 160 and distal end 110*b* of conduit 110 can be coupled together in many different ways, such as by using various pins and fasteners. Coupler 160 is coupled to proximal end 115*b* of conduit 115 by using a locking pin (not shown), such as locking pin 150 or 155. It should be noted, however, that coupler 160 and distal end 115*b* of conduit 115 can be coupled together in many different ways, such as by using various pins and fasteners.

In this embodiment, pole assembly 100*b* includes socket piece 140, which is discussed in more detail above. Socket piece 140 is coupled to distal end 115*b* of conduit 115 by using a locking pin (not shown), such as locking pin 150 or 155. It should be noted, however, that socket piece 140 and distal end 115*b* of conduit 115 can be coupled together in many different ways, such as by using various pins and fasteners.

Figure 12A:
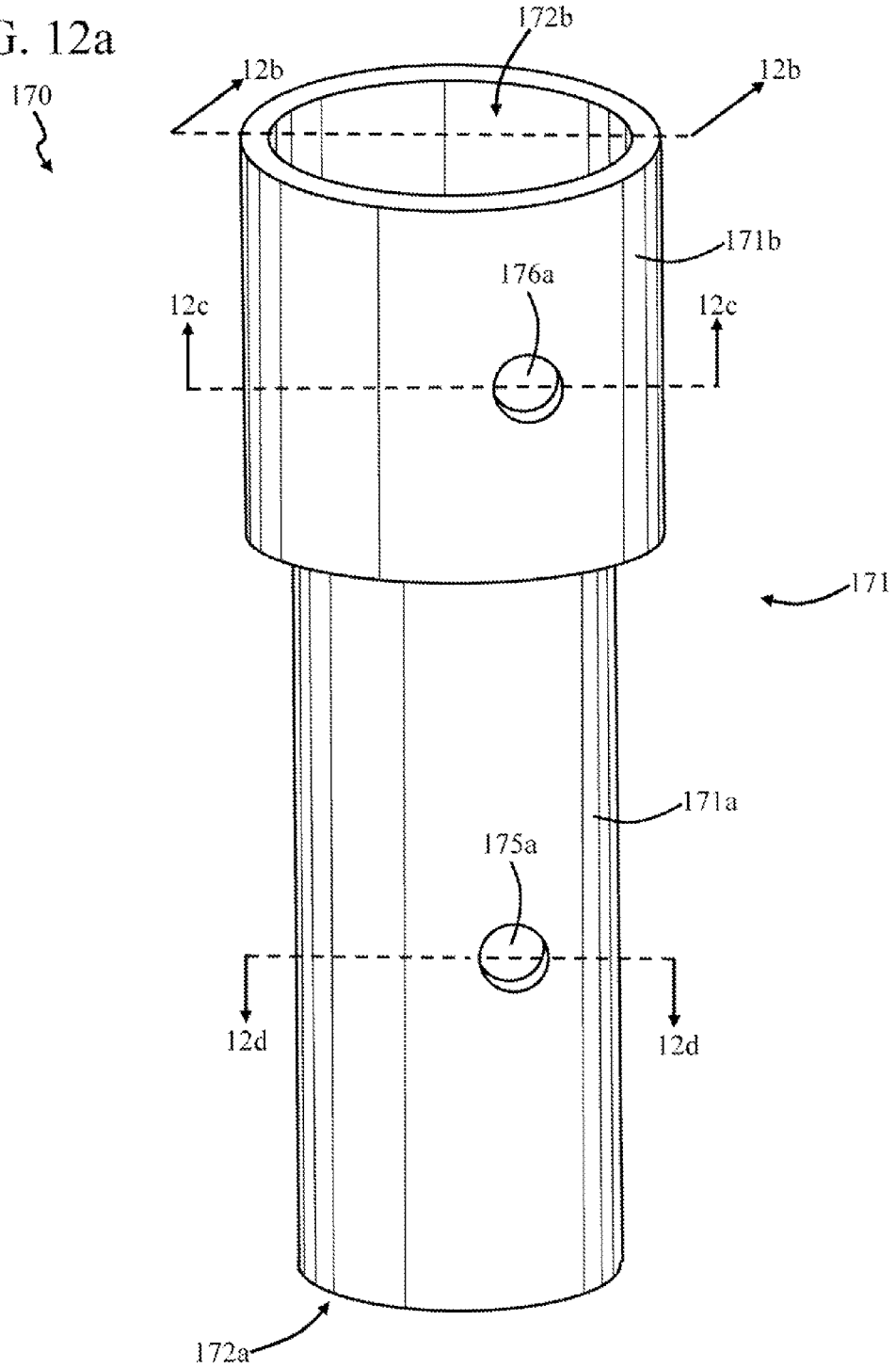
FIG. 12*a* is a perspective view of a universal socket which can be coupled to a conduit.
Figure 12B:
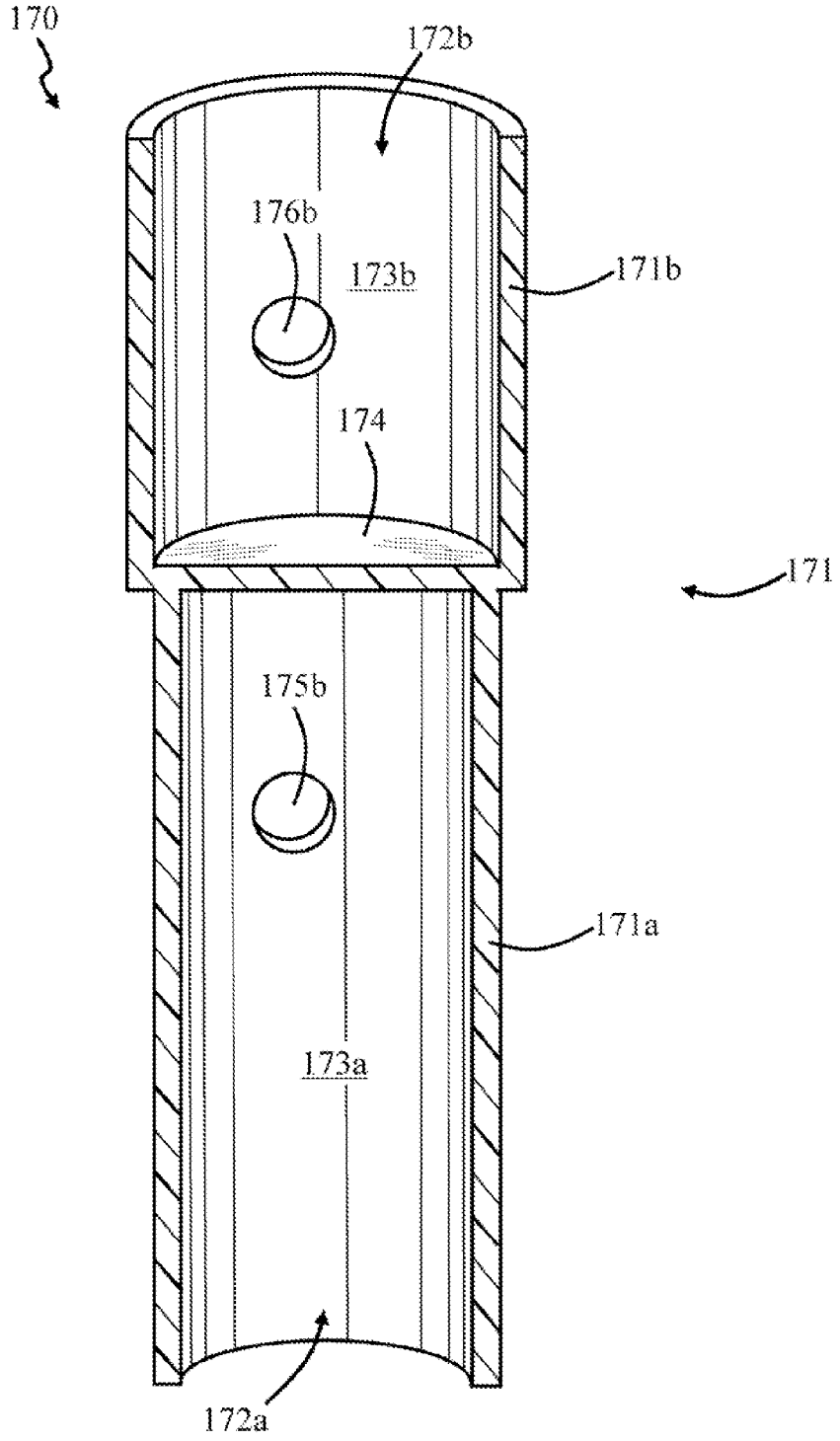
FIG. 12*b* is a cut-away perspective view of the universal socket of FIG. 12*a* taken along a cut-line 12*b*-12*b* of FIG. 12*a*.
Figure 12C:
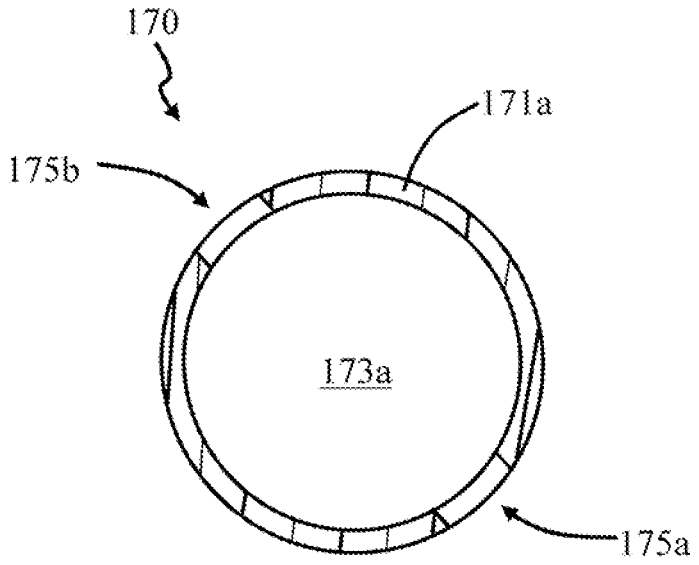
FIG. 12*c* is a cut-away perspective view of the universal socket of FIG. 12*a* taken along a cut-line 12*c*-12*c* of FIG. 12*a*.
Figure 12D:
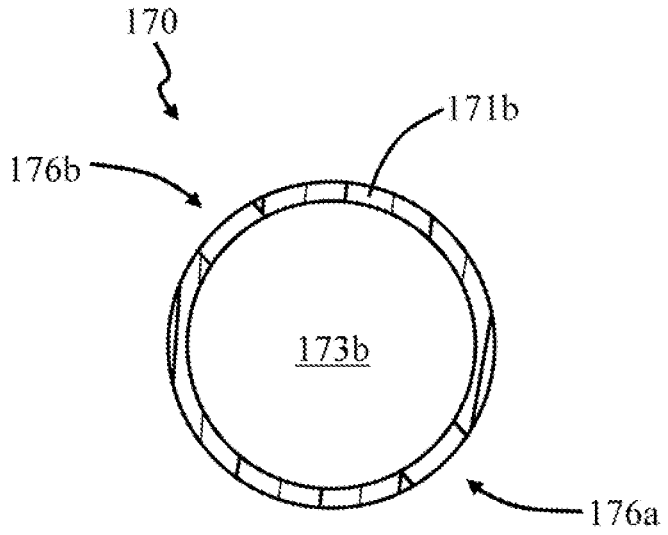
FIG. 12*d* is a cut-away perspective view of the universal socket of FIG. 12*a* taken along a cut-line 12*d*-12*d* of FIG. 12*a*.

FIG. 12*a* is a perspective view of a universal socket 170 which can be coupled to a conduit, such as conduit 110. FIG. 12*b* is a cut-away perspective view of universal socket 170 taken along a cut-line 12*b*-12*b* of FIG. 12*a*, and FIG. 12*c* is a cut-away perspective view of universal socket 170 taken along a cut-line 12*c*-12*c* of FIG. 12*a*. FIG. 12*d* is a cut-away perspective view of universal socket 170 taken along a cut-line 12*d*-12*d* of FIG. 12*a*.

In this embodiment, universal socket 170 includes a universal socket body 171 having a conduit fitting body 171*a* and socket fitting body 171*b*. An unsocketed body opening 172*a* extends through conduit fitting body 171*a*, and an unsocketed body channel 173 extends through conduit fitting body 171*a* and between unsocketed body opening 172*a* and a stop piece 174. Unsocketed body opening 172*a* is sized and shaped to receive distal conduit end 110*b* of conduit 110. Body channel 173*a* is unsocketed because it does not include a facet.

Unsocketed body opening 172*b* extends through socket fitting body 171*b*, and an unsocketed body channel 173*b* extends through socket fitting body 171*b* and between unsocketed body opening 172*b* and stop piece 174. Body channel 173*b* is unsocketed because it does not include a facet.

Socket piece 140 includes opposed proximal fastener opening 175*a* and 175*b*, which extend through conduit fitting body 171*a*. Fastener openings 175*a* and 175*b* are positioned opposed to each other, as shown in FIG. 12*c*, so that an object, such as a fastener, can be extended through them. Further, fastener openings 175*a* and 175*b* are positioned so that conduit fastener openings 118*a* and 118*b* are aligned with fastener openings 175*a* and 175*b*, respectively, when distal conduit end 110*b* of conduit 110 is extended through unsocketed body opening 172*a*. In this way, a fastener (not shown) can be extended through unsocketed body opening 172*a* and conduit fastener openings 118*a* and 118*b* so that socket piece 140 and distal conduit end 110*b* of conduit 110 are coupled together.

Socket piece 140 includes opposed distal fastener openings 176*a* and 176*b*, which extend through socket fitting body 171*b*. Fastener openings 176*a* and 176*b* are positioned opposed to each other, as shown in FIG. 12*d*, so that an object, such as a fastener, can be extended through them.

Unsocketed body opening 172*b* is sized and shaped to receive an object, such as a socketed chuck. Corresponding fasteners are extended through distal fastener openings 176*a* and 176*b* to hold the object in unsocketed body channel 173*b*, as will be discussed in more detail presently.

Figure 13A:
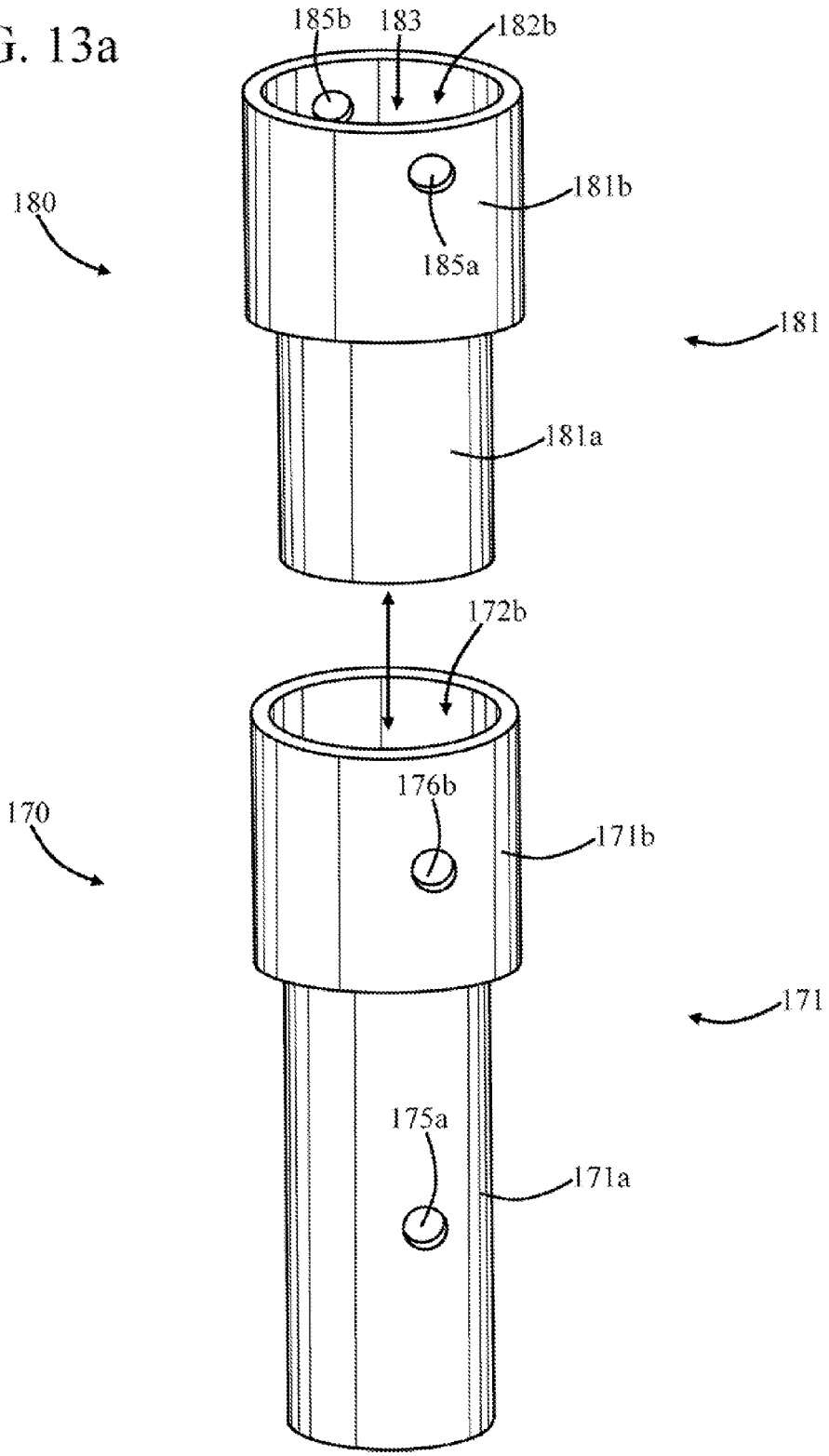
FIG. 13*a* is a perspective view of a socketed chuck which can be coupled to the universal socket of FIG. 12*a*.

FIG. 13*a* is a perspective view of a socketed chuck 180, which can be coupled to universal socket 170 of FIG. 12*a*. In this embodiment, socketed chuck 180 includes a socketed chuck body 181 having a socket chuck fitting 181*a* and socket chuck holder 181*b*. An unsocketed chuck opening 182*b* extends through socket chuck holder 181*b*, and an unsocketed body channel 183 extends through socket chuck holder 181*b*. Body channel 183 is unsocketed because it does not include a facet. Socket piece 140 includes opposed proximal fastener openings 185*a* and 185*b*, which extend through socket chuck holder 181*b*. Fastener openings 185*a* and 185*b* are positioned opposed to each other. Unsocketed chuck opening 182*b* is sized and shaped to receive an object, such as a socketed plug. Corresponding fasteners are extended through distal fastener openings 185*a* and 185*b* to hold the object in unsocketed body channel 183, as will be discussed in more detail presently.

Figure 13B:
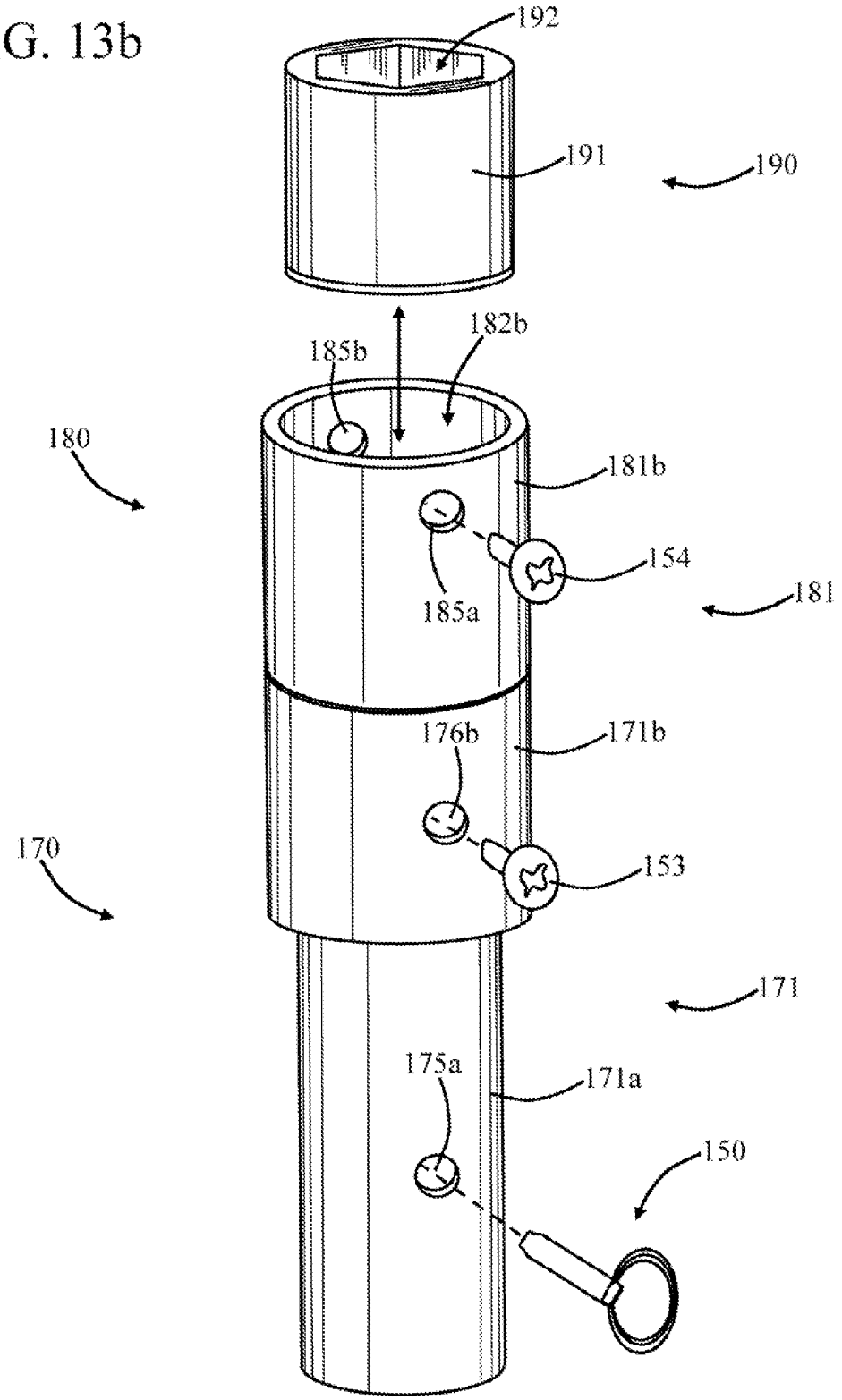
FIG. 13*b* is a perspective view of a socketed plug which can be coupled to the socketed chuck of FIG. 13*a*.

FIG. 13*b* is a perspective view of a socketed plug 190, which can be coupled to socketed chuck 180 of FIG. 13*a*. In this embodiment, socketed plug 190 includes a socket plug body 191, and a socketed plug opening 192 extending through socket plug body 191. Socket plug body 191 is sized and shaped to be received by unsocketed chuck opening 182*b* and unsocketed body channel 183. Plug opening 192 is socketed because it includes at least one facet. A fastener, such as fastener 154, is extended through distal fastener openings 185*a* and 185*b* to hold socketed plug 190 in unsocketed body channel 183. In this way, socketed plug 190 is coupled to socketed chuck.

Figure 13C:
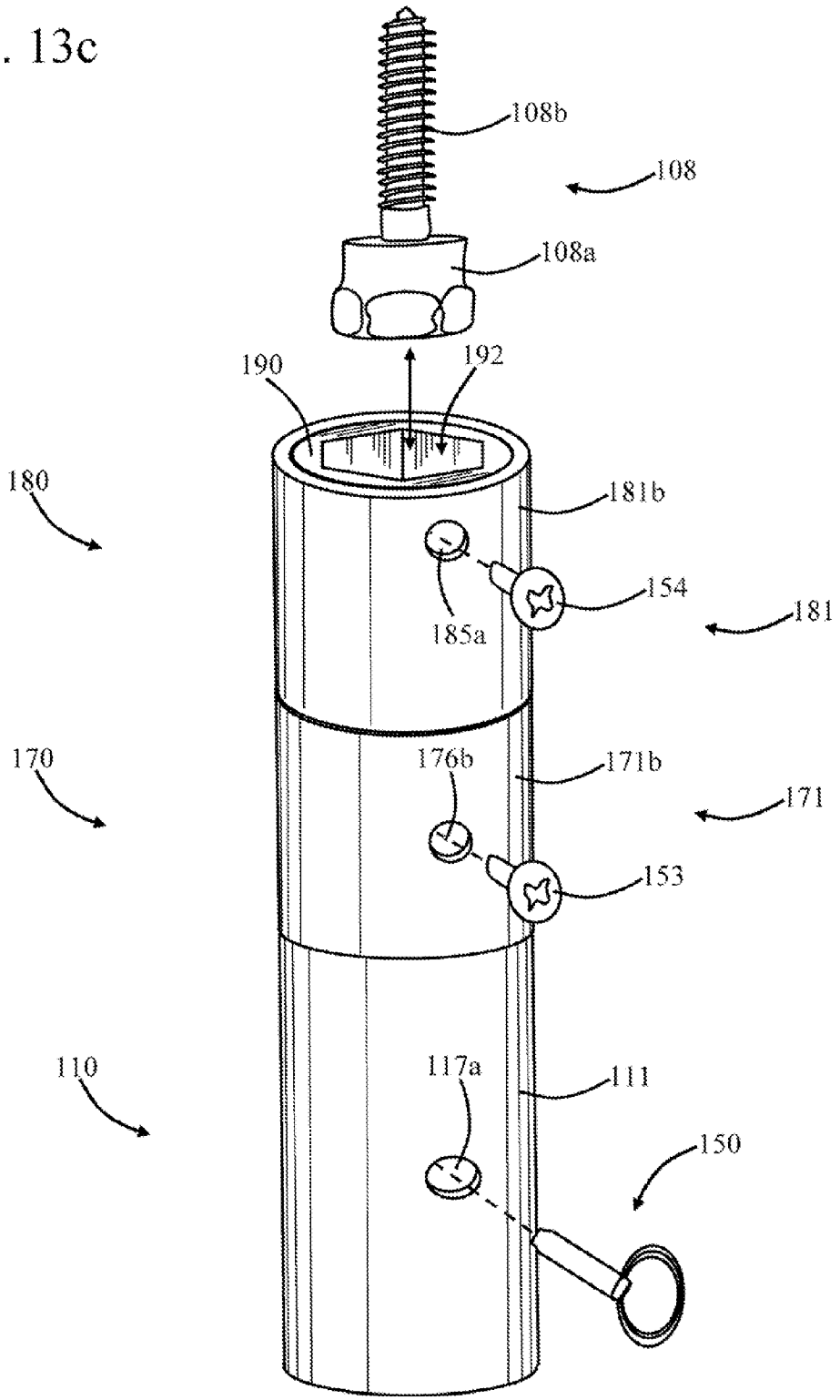
FIG. 13*c* is a perspective view of the fastener of FIG. 3*a* which can be coupled to the socketed plug of FIG. 13*b*.

FIG. 13*c* is a perspective view of fastener 108 of FIG. 2*a*, which can be coupled to socketed plug 190 of FIG. 13*b*. In this embodiment, head 108*a* is moved through socketed plug opening 192. Head 108*a* is faceted so that it matches the facets of plug opening 192, and fastener 108 will rotate in response to the rotation of socketed plug 190. Conduit 110 is coupled to universal socket 170 by extending conduit fitting body 171*a* through conduit body channel 113 proximate to distal conduit end 110*b*. Pin 150 is then used to couple conduit 110 to universal socket 170 by extending pin shank 152 through conduit fastener openings 118*a* and 118*b*, as well as through proximal fastener openings 175*a* and 175*b*. It should be noted that socketed plug 190 rotates in response to the rotation of conduit 110. Conduit 110 can be rotated in many different ways, such as by using, drill 101.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

The invention claimed is:

1. A pole assembly, comprising:

a chuck, which includes a chuck body with a distal chuck body opening, a chuck stop piece, opposed fastener openings extending therethrough the chuck body, a shank, which extends away from the distal chuck body opening and chuck stop piece, wherein said distal chuck body opening extends perpendicular to the opposed fastener openings;

a socket piece, which includes a conduit fitting body and a socket fitting body, and opposed fastener openings extending through the conduit fitting body, a socket stop piece which extends between the conduit fitting body and socket fitting body, and a socketed body opening extending therethrough the socket fitting body;

a conduit received within the distal chuck body opening of the chuck and further received within an unsocketed body opening of the conduit fitting body, the conduit engaging an inner periphery of the chuck body and the conduit fitting body, wherein the conduit consists of EMT conduit.

2. The pole assembly of claim 1, further including a first pin which couples the conduit to the chuck, wherein the first pin extends through the conduit and the opposed fastener openings of the chuck body.

3. The pole assembly of claim 2, further including a second pin which couples the conduit to the socket piece, wherein the second pin extends through the conduit and the opposed fastener openings of the conduit fitting body.

4. The pole assembly of claim 1, wherein the socketed body opening includes a plurality of facets.

5. The pole assembly of claim 1, further including a fastener which extends through the socketed body opening.

6. A pole assembly, comprising:

a chuck, which includes a chuck body with a distal chuck body opening, a chuck stop piece, opposed fastener openings extending therethrough the chuck body, a shank extending away from the distal chuck body opening and chuck stop piece, wherein said distal chuck body opening extends perpendicular to the opposed fastener openings;

a coupler, which includes a proximal fitting body, a distal fitting body, and a coupler stop piece positioned between said proximal and distal fitting bodies, the coupler further including proximal fastener openings extending through the proximal fitting body and distal fastener openings extending through the distal fitting body;

a first conduit received within the distal chuck body opening of the chuck and further received within a proximal coupler opening of the coupler, the first conduit engaging an inner periphery of the chuck body;

a socket piece, which includes a conduit fitting body and a socket fitting body, and opposed fastener openings extending through the conduit fitting body, a socket stop piece which extends between the conduit fitting body and socket fitting body, and a socketed body opening extending through the socket fitting body; and a second conduit received within a distal coupler opening of the coupler and further received within an unsocketed body opening of the conduit fitting body, the second conduit engaging an inner periphery of the conduit fitting body, wherein the first and second conduits consist of EMT conduit.

7. The pole assembly of claim 6, further including a first pin which couples the first conduit to the chuck, and a second pin which couples the first conduit to the coupler.

8. The pole assembly of claim 7, further including a third pin which couples the second conduit to the coupler, and a fourth pin which couples the second conduit to the socket piece.

9. The pole assembly of claim 6, wherein the socketed body opening includes a plurality of facets.

10. The pole assembly of claim 6, further including a fastener which extends through the socketed body opening.

* * * * *